US005450683A

United States Patent [19]

Miller, IV

[11] Patent Number: 5,450,683

[45] Date of Patent: Sep. 19, 1995

[54] WEAPON MAGAZINE

[76] Inventor: John O. Miller, IV, P.O. Box 535, Absarokee, Mont. 59001

[21] Appl. No.: 320,899

[22] Filed: Oct. 11, 1994

[51] Int. Cl.[6] ..... F41A 9/65

[52] U.S. Cl. ..... 42/50; 221/278; 221/279; 42/7

[58] Field of Search ..... 42/50, 7; 89/33.1; 221/226, 278, 279

[56] References Cited

U.S. PATENT DOCUMENTS

| | | | |
|---|---|---|---|
| Re. 30,374 | 8/1980 | Spencer | 414/404 |
| 210,976 | 12/1978 | Storm | 221/226 |
| 3,130,865 | 4/1964 | Ono et al. | 221/226 |
| 3,205,604 | 12/1942 | Plumber | 42/50 |
| 3,854,376 | 12/1974 | Elmore et al. | 89/33.1 |
| 4,582,463 | 4/1986 | Schreiner | 414/118 |

*Primary Examiner*—Charles T. Jordan

*Assistant Examiner*—Christopher K. Montgomery

*Attorney, Agent, or Firm*—Terrance L. Siemens

[57] ABSTRACT

An improved magazine construction for gas powered firearms or other single object dispensing unit is disclosed. The expanding gasses from the breech or barrel of the gun are directed into the bottom portion of the magazine where they are introduced into a chamber having varying capacity. The upper portion of the chamber is movable and forms the follower, which includes integral biasing means thereon to provide additional impetus for urging the cartridges upwards into the receiver. The body of the follower also includes spring loaded cammed pins that engage cooperating pin holes in the inner magazine wall to provide a ratcheting action as the follower advances. These pinholes also serve as a excess pressure relief, allowing the gasses to escape through a blow by rail located between the inner and outer magazine walls.

4 Claims, 2 Drawing Sheets

WEAPON MAGAZINE

BACKGROUND OF THE INVENTION

1. Field of the Invention

The present invention relates to firearms. More specifically, it relates to a firearm magazine. Even more specifically, it relates to a firearm magazine wherein the expanding gasses from the breech are used to advance the bullets in the magazine. Yet even more specifically, it relates to a gas actuated firearm magazine wherein a piston that includes a biasing portion serves as a follower. More generally, the present invention could be used in any application where compressed gasses are used to advance one object at time a specified distance, such as in various manufacturing processes.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. DESCRIPTION OF THE PRIOR ART

Magazines for feeding ammunition into a firearm that utilize the expanding gasses from the previous cartridge's explosion to move the next into the firing chamber are known. Likewise, springs have been used to advance the cartridges in a magazine and to ensure their proper positioning and feeding into the firing chamber. Still, the occasional misfire or "jam" will occur. The present invention seeks to address this problem by providing a unique piston arrangement with a resilient member on the top thereof, to thus doubly assure the proper advancement of the cartridge. Extending from the sides of the piston portion of the device are a number of biased and cammed ratcheting pins that cooperate with apertures on the inner wall of the magazine assembly. Between the inner and outer wall of the magazine is a blow by rail to allow any excess gas to be vented. As will be seen, the simplicity and effectiveness of my invention is not rivaled in the prior art.

During a search at the U.S. Patent and Trademark Office, a number of related patents were uncovered that are discussed hereinbelow:

U.S. Pat. No. 2,569,995, issued to Lumir Vojtech Kapsa on Oct. 2, 1951, shows a spring fed magazine primarily for use in air guns. This device consists of a tube with a pushing member and a compression spring. This is dissimilar from the present invention in that no utilization of gas from an exploding cartridge is discussed.

U.S. Pat. No. 2,620,582, issued to Earl M. Stukas on Dec. 9, 1952, shows a firearm magazine wherein a compression spring impels a follower in the magazine to urge the bullets forward. On one side of the magazine is an elongated slot through which protrudes a button that is attached to the follower. On the opposite side of the magazine there is a rectangular opening, to allow for the loading of cartridges, that is secured by a removable cover plate. Thus, the follower can be retracted by the button and the magazine filled. By contrast, the device of the instant invention is impelled by the expanding gasses of a fired cartridge.

U.S. Pat. No. 2,828,568, issued to Edwin G. Sakewitz on Apr. 1, 1958, shows a cartridge indicating magazine for pistols. This device also uses a spring to impel the follower and includes a visual numerical indicator. By contrast, the device of the instant invention, as mentioned in the discussion of the Stukas patent above, utilizes the expanding gasses from the breech of the firearm.

U.S. Pat. No. 3,069,976, issued to Frederick F. Stevens on Dec. 25, 1962, shows a gas operated semi-automatic pistol wherein the residual gas pressure remaining in the barrel after firing moves a cam follower to relieve tension on a series of springs to both eject the empty cartridge and move the next bullet into the breech. This is dissimilar from the present invention in that no gas driven piston within the magazine directly in contact with the magazine follower is disclosed.

U.S. Pat. No. 4,343,107, issued to Benno Kaltenegger or Aug. 10, 1982, shows a cartridge magazine for pistols. This is another of the spring loaded magazine type and as such is dissimilar from the present invention, which uses the gas pressure from the breech to advance the succeeding cartridge.

Another patent of interest is U.S. Pat. No. 4,495,720 issued on Jan. 29, 1985 to Robert Bross. This discloses a handgun magazine with a pommel base. Unlike the present invention, there is no teaching of using the gasses from the breech of the gun to impel the cartridges in the magazine.

U.S. Pat. No. 4,563,937 issued to Bernard C. White on Jan. 14, 1986 discloses a gas actuated pistol wherein a vent proximate the muzzle of the barrel allows the compressed gasses to enter a chamber and drive a piston body, and thus a bolt carrier, rearwards to withdraw the bolt from the barrel assembly and likewise eject the casing. However, the cartridges in the magazine are urged towards the breech by a spring mechanism, thus differentiating this disclosure from the instant invention.

Next is U.S. Pat. No. 4,811,510 issued to M. Gaines Chestnut on Mar. 14, 1989. This discloses a cartridge magazine with means for increasing the number of rounds that it can hold. This is accomplished through use of a conforce spring in combination with leaf springs that also serve as legs on the follower body. As in a number of the patents discussed above, this is clearly dissimilar from the instant invention, as no use of the compressed gasses from the breech is disclosed.

In U.S. Pat. No. 5,206,444 issued to Harry M, Oliver on Apr. 27, 1993 there is disclosed a device for indicating the number of rounds left in a magazine. This involves a Z shaped slot on the side of the magazine and markings on the follower. Unlike the present invention, there is disclosed no contemplation of using the gasses from the breech to advance the cartridges.

Lastly, U.S. Pat. No. 5,218,163 issued to Gary P. Dabrowski on Jun. 8, 1993 discloses a pressure relief mechanism for a gas operated firearm. This includes a number of spherical valve elements seated about the gas cylinder to vent excess pressure in a forward direction. This is dissimilar from the instant invention as there is no teaching towards either a piston powered follower, nor of the unique ratcheting pin arrangement disclosed herein.

None of the above inventions and patents, taken either singly or in combination, is seen to describe the instant invention as claimed.

SUMMARY OF THE INVENTION

The present invention is an improved magazine construction for gas powered firearms. The expanding gasses from the breech or barrel of the gun are directed into the bottom portion of the magazine where they are introduced into a chamber having varying capacity. The upper portion of the chamber is movable and forms the follower, which includes integral biasing means thereon to provide additional impetus for urging the cartridges upwards into the receiver. The body of the follower also includes spring loaded cammed pins that engage cooperating pin holes in the inner magazine wall to provide a ratcheting action as the follower advances. These pinholes also serve as a excess pressure relief, allowing the gasses to escape through a blow by rail located between the inner and outer magazine walls.

Accordingly, it is a principal object of the invention to provide a new and improved magazine construction which overcomes the disadvantages of the prior art in a simple but effective manner.

It is a major object of this invention to provide an improved magazine construction wherein the follower motion is induced by compressed gasses, and where the number of moving parts and thus the possibility of material failure, is minimized.

It is another object of the invention to provide an improved magazine construction wherein the follower is retained in position through a plurality of spring loaded pins that engage mating pin holes in the inner wall of the magazine, causing a ratcheting action as the follower advances.

It is another object of the invention to provide an improved magazine construction wherein the follower body includes an integral biasing portion to ensure that the cartridges (or other dispensed objects) are held firmly in place against the magazine throat.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
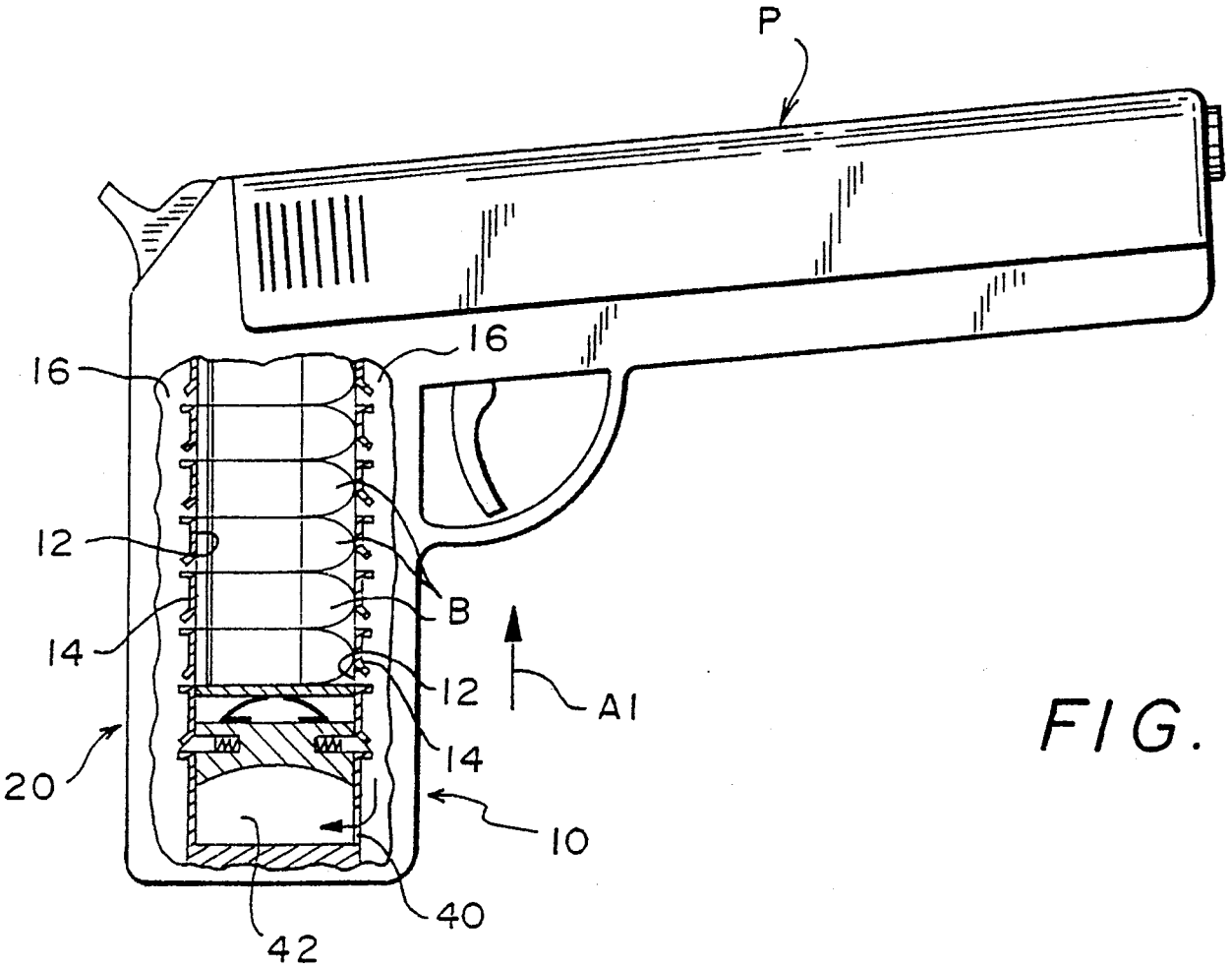
FIG. 1 is a partially cutaway perspective view of the present invention with the gun body being shown in broken lines.
Figure 3:
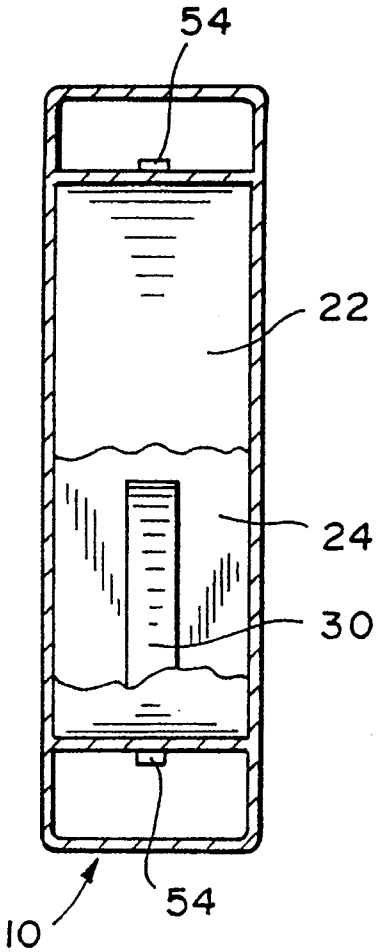
FIG. 3 is view taken along line 3—3 of FIG. 2 with a part of the lower follower body member cut away to show the attachment of the preferred integral leaf spring bias means to the upper follower member.
Figure 2:
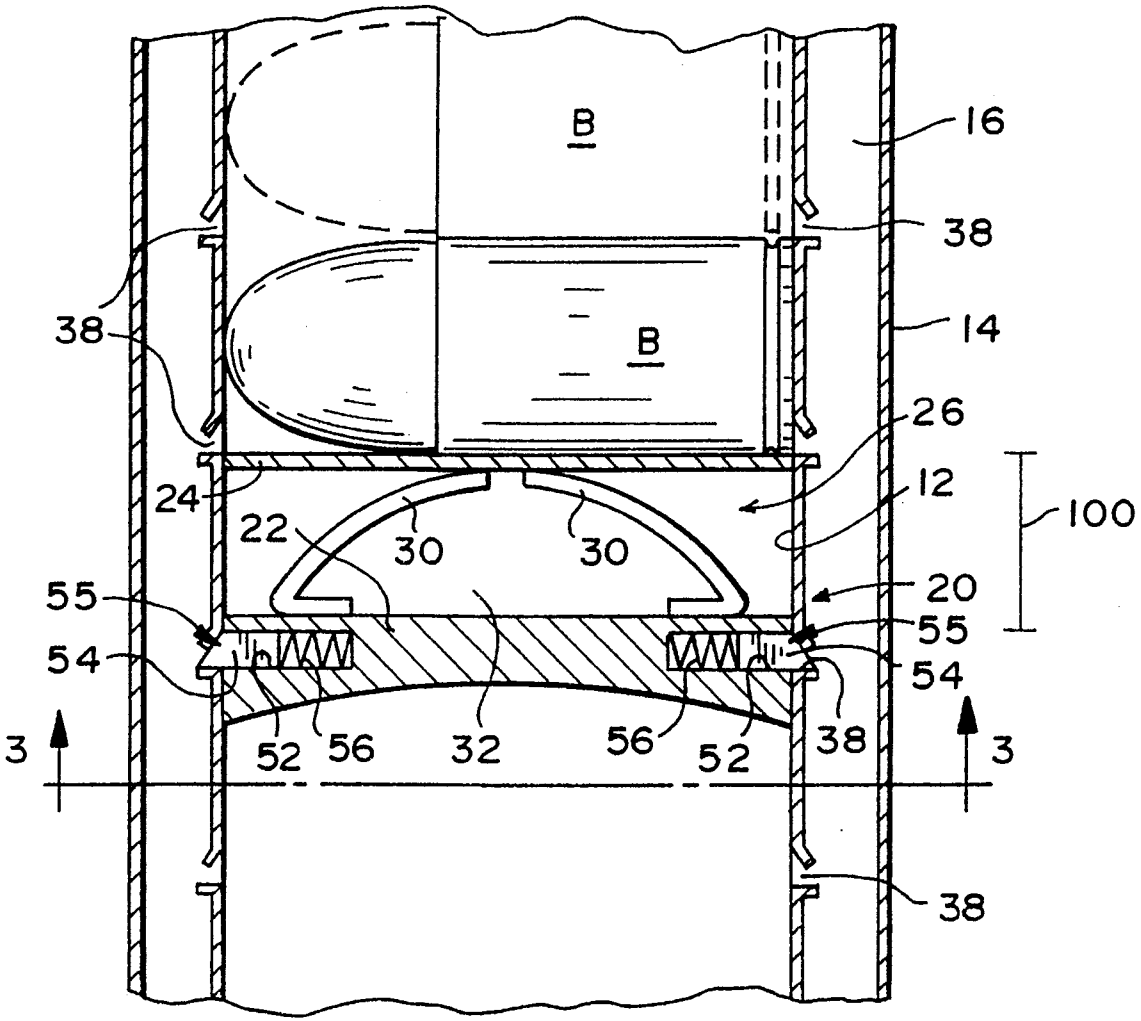
FIG. 2 is an expanded view of the follower within the magazine according to the present invention.

The present invention is indicated at 10 in FIG. 1. In this figure, the magazine 10 is shown in place within the grip of a firearm, in this case a pistol P. It should be emphasized at the outset, however, that the present invention is not limited to a handgun, or even necessarily to firearms in particular. The unique construction disclosed herein could be made use of in a wide variety of applications where one object at time needs to be presented at a magazine or storing structure throat. Referring now to FIGS. 1 and 2, the magazine 10 has an inner wall 12 and an outer wall 14. The space between these walls 12 and 14 defines a blow by rail 16, which will be discussed in more detail below. Fitting substantially completely within the inner wall 12 of the magazine 10 is the follower 20. The follower 20 (with special attention to FIG. 2) consists of a lower member 22, an upper member 24, and a bias means portion 26, which lies between the upper and lower members, 22 and 24 respectively. In the preferred embodiment, the biasing. means is a pair of leaf springs 30 fixedly attached to both the upper member 24 and the lower member 22. This is clearly shown in the partial cutaway view of FIG. 3. These leaf springs 30 could be attached by any number of means such as soldering, riveting, or the like and span a plenum 32 defined by the lower and upper members 22, 24. The springs 30 ensure that the cartridges B (shown in FIGS. 1 and 2), or other objects to be dispensed, are firmly held in place in relation to the magazine 10 by virtue of the constant force applied in a direction towards the magazine throat. Though leaf springs are shown in this embodiment, it should be emphasized that other types, such as a coil spring could easily be substituted without departing from the spirit of the invention.

Disposed in the lower member 22 of the follower 20 are a pair of apertures 52. Within these apertures 52 are disposed biased magazine wall engagement pins 54. These pins 54 are each urged outwardly by pin springs 56 that are attached within the apertures 52. Disposed on the inner wall 12 and extending therethrough are pin receiving apertures 38. These receiving apertures 38 are positioned such that as the follower 20 travels up the inner portion of the magazine 10, the pins 54 are engaged within the receiving apertures 38 at the appropriately spaced intervals to provide proper feeding for the bullets B or other objects being dispensed from the magazine. This interval, shown at 100 in FIG. 2, is approximately equal to the width of the dispensed object; in this case the cartridges B. The pins 54 have a cam surface 55 that urges them inwardly against the springs 56 when the follower 20 moves upwardly.

The discussion now turns to the operation of the improved magazine of the present invention. The expanding gasses from the breech or muzzle (not shown) of pistol P are diverted into a magazine gas entry port 40 (seen in FIG. 1). The gasses then enter the variable volume chamber 42 that is bounded on one side by the lower follower member 22. The lower follower member 22 has a concave bottom that aids in focusing the force of the gasses entering the chamber 42 towards impelling the follower 20 upwardly, as indicated by directional arrow A 1 in FIG. 1. The camming surfaces 55 or the pins 54 urge them against the springs 56 thus placing them substantially into apertures 52. When the follower 20 reached the next set of receiving apertures 38, located on the inner magazine wall 12, the springs 56 force the pins 54 thereinto, thus locking the follower temporarily into that position to await the next discharge of the pistol P. The apertures 38 that extend through the inner wall 12 of the magazine 10 also serve as a means to allow excess pressure to escape into a blow by rail 16, located between the inner wall 12 and the outer wall 14 of the magazine 10. This blow by rail 16 is preferably attached to existing vents (not shown) in the pistol P to safely direct the gasses away from the user. It should be understood though, that the location and specifics of the vents (not shown) are not germane to the functioning of the present invention.

Thus it can be seen that the instant invention provides an alternative to existing gas magazines in the firearm art, by using few moving parts to lessen the possibility of breakdown or misfires in the gun. The present invention also provides a gas powered magazine dispenser that could be used in other applications where a single object is desired to be presented at the magazine mouth or throat in a fixed, firmly held relationship thereto. It should also be pointed out that the compressed gasses that power the follower need not be derived from an explosion. The gasses could be measured and dispensed from a tank or other holding device.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions as discussed above.

It is to be understood that the present invention is not limited to the sole embodiment described above, but encompasses any and all embodiments within the scope of the following claims:

I claim:

1. A magazine type dispenser apparatus comprising:

means to define an object storage area, said means including an inner wall and an outer wall, said inner and outer wall defining a space therebetween, said object storage area further including a top and a bottom, said top having opening means therein to define a magazine throat and said bottom being generally closed;

a plurality of apertures disposed on said inner wall of said storage area, said apertures extending therethrough to allow fluid communication between said storage area and said space between said inner and said outer walls;

gas entry port proximate said bottom of said storage area;

follower means disposed within said inner wall of said storage area, said follower means substantially subdividing said storage area into an upper and a lower portion, said follower including biased pins, said biased pins configured to be engageable with said apertures disposed on said inner wall; whereby compressed gas is introduced through said gas entry port, and follower incrementally advances towards said top of said storage area thus presenting the stored objects at said magazine throat.

2. The magazine according to claim 1, wherein said biased pins are disposed opposite to one another.

3. The magazine according to claim 1, wherein said follower comprises an upper member and a lower member, with a plenum disposed therebetween, and where a resilient spring member is located within said plenum, said spring member being attached to both said lower and said upper member.

4. The magazine according to claim 3, wherein said spring member comprises a pair of leaf springs.

* * * * *